United States Patent [19]

Gidge

[11] 4,337,950

[45] Jul. 6, 1982

[54] CIRCULAR BOOMERANG

[76] Inventor: Kenneth N. Gidge, 22 Hayden St., Nashua, N.H. 03060

[21] Appl. No.: 148,663

[22] Filed: May 12, 1980

[51] Int. Cl.[3] ..... A63B 65/08

[52] U.S. Cl. ..... 273/426

[58] Field of Search ..... 273/426, 425; 46/740

[56] References Cited

U.S. PATENT DOCUMENTS

| | | | |
|---|---|---|---|
| 692,608 | 2/1902 | Bristow | 273/426 |
| 862,094 | 7/1907 | Morton | 273/426 X |
| 2,035,629 | 3/1936 | Wing | 273/426 X |
| 2,324,022 | 7/1943 | Prause, Jr. | 273/426 |
| 2,972,481 | 2/1961 | Shapiro | 273/426 |
| 3,082,572 | 3/1963 | Knox, Jr. | 273/426 X |
| 3,955,817 | 5/1976 | Davis | 273/426 X |
| 4,045,029 | 8/1977 | Katzmark | 273/425 |

FOREIGN PATENT DOCUMENTS

| | | | |
|---|---|---|---|
| 411972 | 6/1910 | France | 273/426 |
| 919701 | 12/1946 | France | 273/426 |

*Primary Examiner*—Paul E. Shapiro

*Attorney, Agent, or Firm*—Morse, Altman, Oates & Dacey

[57] ABSTRACT

A toy boomerang is provided in the form of a generally flat circular body having a plurality of spiral arms extending between a central hub and an outer annulus. Each spiral arm defines an airfoil providing lift to the toy when it is spun through the air. The toy is used by spinning it into the air by a swinging, snapping movement of the arm and wrist whereupon the toy will follow a rising straight trajectory to a stall point and then reverse its direction and return directly back to the thrower.

9 Claims, 13 Drawing Figures

CIRCULAR BOOMERANG

BACKGROUND OF THE INVENTION

1. Field of the Invention

This invention relates generally to spinnable flying toys and more particularly is directed towards a circular, generally flat, spinnable toy displaying distinct boomerang characteristics.

2. Description of the Prior Art

There have been available for a number of years a variety of different spinnable toys that may be thrown back and forth between two or more participants. The ubiquitous "FRISBEE" disc toy is enjoyed by young and old alike and provides both enjoyment and excercise to those playing with it. One drawback with this type of toy is that it requires at least two participants so that it may be tossed back and forth. An individual cannot conveniently use such a toy since he would have to retrieve it after each toss. While the excercise and enjoyment derived from tossing an ojbect of this type is available to an individual using a boomerang, the boomerangs presently available tend to be somewhat dangerous in use and, in fact, their original purpose was that as a weapon.

While attempts have been made in the past to develop a boomerang characteristic in a spinnable disc-type toy that is both simple and harmless, the reslts thus far have not been entirely satisfactory, particularly from the standpoint of performance.

Accordingly, it is an object of the present invention to provide a simple, inexpensive spinnable toy having boomerang characteristics for use particularly by an individual.

Another object of this invention is to provide a safe spinnable toy having a distinct boomerang action that allows for a variation in the flight characteristics of the toy, depending upon the manner in which the toy is thrown.

SUMMARY OF THE INVENTION

This invention features a boomerang-action spinnable throwing toy, comprising a unitary body having a plurality of spiral arms extending in a common plane from a central hub and terminating at their outer ends in an annular rim. Each spiral arm defines an airfoil in cross-section to provide lift for the device when spun through the air. When tossed into the air, with a spinning motion, the device will follow a rising trajectory to a stall point and, while still spinning, move backwards along a return path to the thrower.

DETAILED DESCRIPTION OF THE PREFERRED EMBODIMENTS

Figure 5:
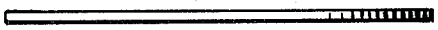
FIG. 5 is a view in side elevation thereof.
Figure 6:
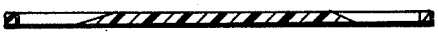
FIG. 6 is a cross-sectional view taken along the line 6—6 of FIG. 3.

Referring now to the drawings and to FIGS. 1 through 7 in particular, there is illustrated a boomerang toy made according to the invention and generally indicated by the reference character 10. The toy, in the preferred embodiment, is of one-piece construction, typically fabricated from a relatively stiff plastic material as by injection molding techniques and in plan view is of circular outline. When viewed on edge as shown in FIG. 5, the toy is flat. In the preferred embodiment of the invention the toy has a diameter of approximately 1 foot and a thickness of about 3/16". The material used for the toy should be relatively stiff and, while plastic is preferred because of its many desirable characteristics, the toy could be made of other material such as wood, metal, fibreglass or the like. Preferably, the toy should be relatively light in weight and a toy having desirable flight characteristics is one having the dimensions described above and a weight in the range of 50–150 grams and preferably about 100 grams. Similar results can be achieved using a toy of different dimensions, but preferably the size-to-weight ratio should remain fairly constant for best results.

Figure 3:
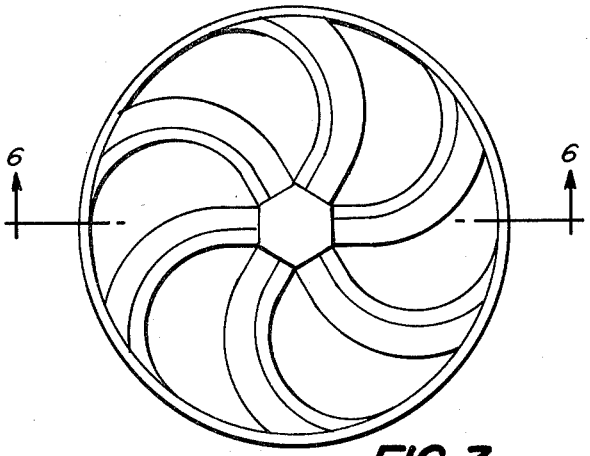
FIG. 3 is a top plan view of the toy.
Figure 4:
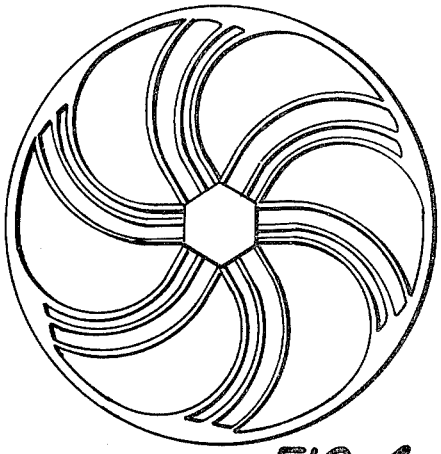
FIG. 4 is a bottom plan view thereof.

The toy 10 as illustrated is comprised of a central hub 12, an outer annular rim 14 and a plurality of spiral arms 16, preferably size in number, evenly angularly spaced about the hub 12. The arms extend from the hub 12 to the rim 14 and, in the preferred embodiment, the arms are spirally curved in a counterclockwise direction when viewed from the top as shown in FIG. 3. Each arm originates at one face of the hexagonal-shaped hub 12 and merges with the rim at an angle about 45° from the point of origin on the hub. Preferably, each arm is about 1" wide and about 6" in length along the curve thereof. The outer end of each arm fairs smoothly into the inner face of the rim 14. The rim preferably is relatively thin and typically is on the order of 2/16" to 3/16". The hub in the preferred embodiment is approximately 2" wide and is of a hexagonal outline, one arm originating at each face of the hub.

Figure 7:
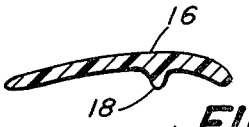
FIG. 7 is a detail sectional view showing the airfoil configuration of one of the spiral arms.

Each of the arms 16 defines an airfoil in cross-section, as best shown in FIG. 7. Each arm 16 is formed with a smoothly contoured convex upper surface and is set at an attack angle with respect to the hub and rim of about 10°. The leading edge of the arm is at the right as shown in FIG. 7 and is somewhat more sharply curved at the forward portion thereof as compared to the somewhat flat and smooth trailing portion thereof. The concave underside of the arm is hollowed out for lightness and rigidity which is enhanced by means of a downwardly facing rib 18 extending substantially the full length of each arm along the underface and towards the leading edge thereof. The rib not only contributes to the rigidity of the arm but also improves the lift characteristics of the toy. The rib is relatively thin and narrow and its lower edge is substantially even with the lowermost edges of the leading and trailing edges of the arm.

Figure 1:
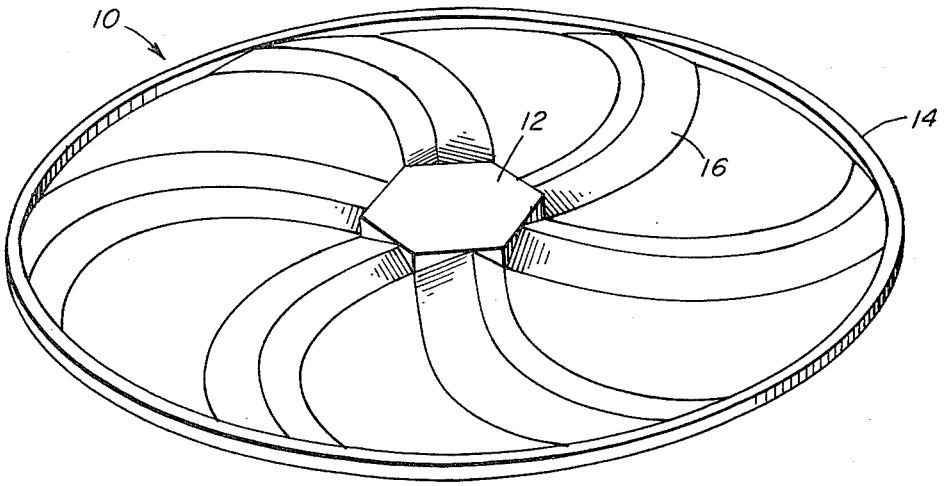
FIG. 1 is a view in perspective of a boomerang-action toy made according to the invention.
Figure 2:
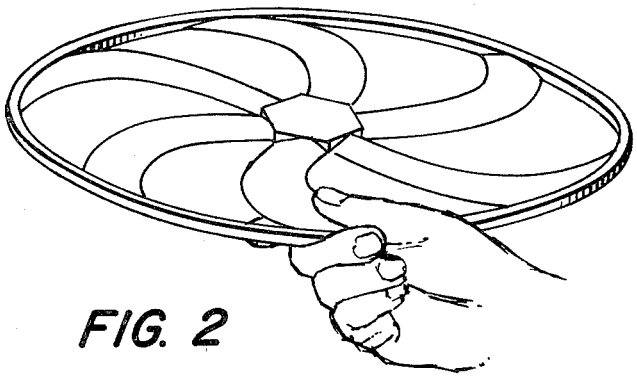
FIG. 2 is a view in perspective showing the manner in which the device is gripped for throwing.
Figure 13:
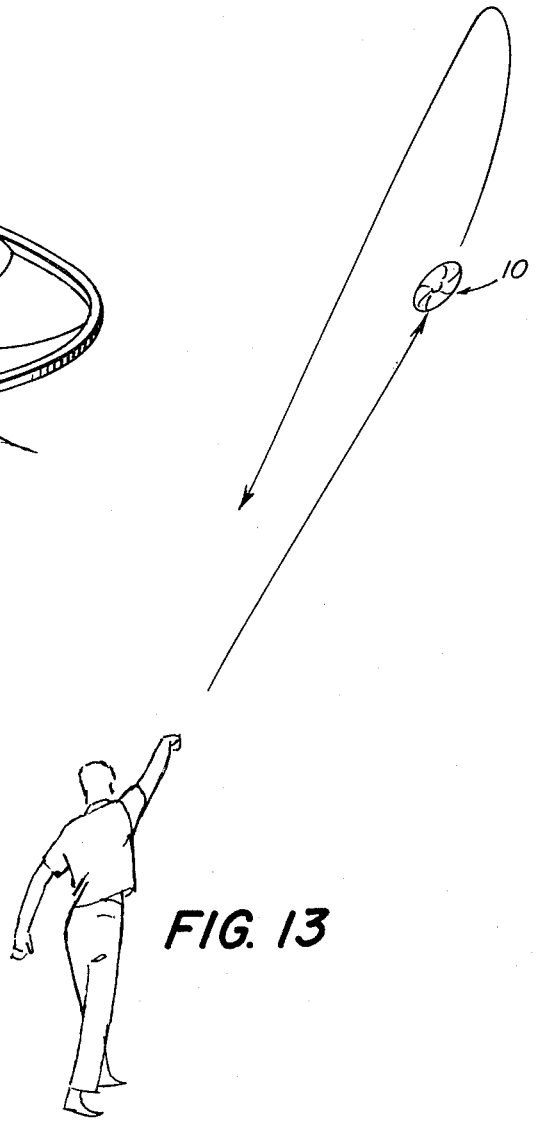

The toy is used in the following manner: It is gripped in the right hand as shown in FIG. 2 with the top side generally in the up position. The toy is then thrown with a spinning motion such that the leading edges of the spiral arms will be moving in a counterclockwise direction. The spinning motion is imparted to the toy by a whipping motion of the arm and wrist so that the toy is spun out and away from the thrower at a slightly positive angle. The toy, as suggested in FIG. 13, will follow a generally straight rising trajectory, the lift being provided by spinning action and airfoil characteristics of the arms. The toy will climb upwardly until it reaches a stall point. At the stall point, the toy will continue to spin but ceases to climb. Instead, it will return back along substantially the same flight path it followed in its outward trajectory and will return directly back to the thrower or in close proximity thereto. The straight out and straight back motion differs from that of a conventional boomerang and other boomerang-action toys which typically do not return directly to the thrower nor along the original flight path. Rather, conventional boomerangs will follow a wide, curving path at the end of which the boomerang will come to rest usually at some distance behind the thrower.

Figure 8:
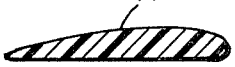
FIGS. 8 and 9 are views similar to view 7 but showing modified airfoil configurations.
Figure 9:
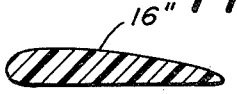

Referring now to FIGS. 8 and 9, there are illustrated two variations of the airfoil configurations of the arms, and, in FIG. 8 it will be seen that an arm 16' is solid in cross-section with the top surface thereof generally identical to that of the top surface of the arm 16 of FIG. 7. The bottom surface however is substantially flat as shown. An arm of the configuration as shown in FIG. 8 is somewhat heavier than the arm of the principal embodiment, however the airfoil configuration does provide the desired lift in the spinning toy. In the FIG. 9 embodiment an arm 16'' is also of a solid cross-section and is the mirror image of the FIG. 8 arm. In the FIG. 9 embodiment, the leading edge is narrow than the trailing edge but the configuration nevertheless provides the desired airfoil characteristics which produce the lifting effect on the device.

Figure 10:
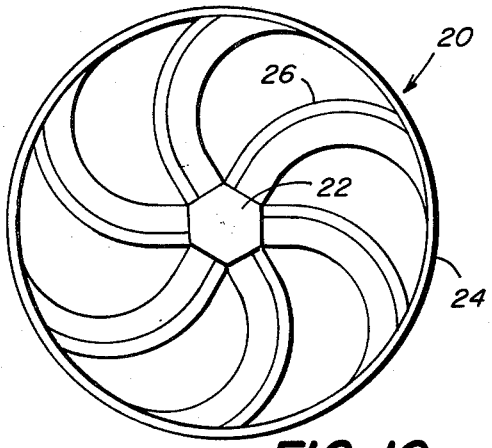
FIG. 10 is a top plan view showing a modification of the invention.
Figure 11:
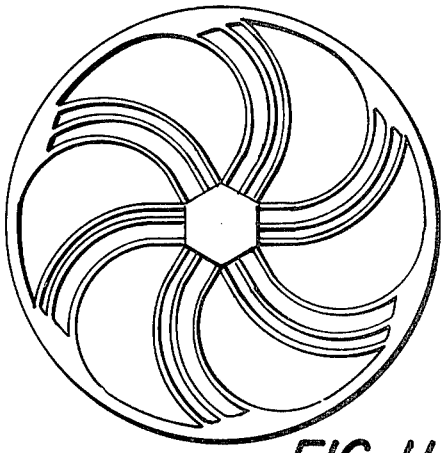
FIG. 11 is a bottom plan view thereof.

Referring now to FIGS. 10 and 11, there is illustrated a modification of the invention and, in this embodiment, a boomerang-action toy 20, similar to the toy 10 of the principal embodiment, is comprised of a central hub 22, an outer rim 24 and a plurality of spiral arms 26. The hub 22 and the rim 24 are identical to the hub 12 and rim 14 of the principal embodiment and the arms 26 are similar to those of the arms 16 in the principal embodiment with the exception that the spiral direction is reversed with the arms curving from the hub to the rim in a clockwise direction. The device is spun in the same manner as the boomerang toy 10 of the principal embodiment and the modification demonstrates the same lift and boomerang characteristics of the principal embodiment.

Figure 12:
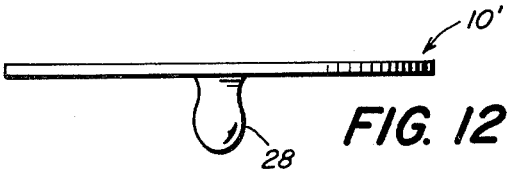
FIG. 12 is a view in side elevation showing yet another modification of the invention, and, FIG. 13 is an illustration demonstrating the action of toy in typical use.

Referring now to FIG. 12, there is illustrated a further modification of the invention and, in this embodiment, a boomerang toy 10' similar to the toy 10 of the principal embodiment is provided with a downwardly extending central handle 28 attached to the hub of the toy. The function of the handle is to provide a convenient means for catching the toy on its return flight.

The flight characteristics of the device may be altered somewhat by the manner in which it is thrown. In the preferred technique the device is released in a generally horizontal and slightly inclined upwards position. In this attitude the device will fly generally straight out and straight back. However, by tilting the device into a more vertical plane upon release, variations in the flight can be achieved, normally producing a more widely curving flight path.

While the invention has been described with particular reference to the illustrated embodiments, numerous modifications thereto will appear to those skilled in the art.

Having thus described the invention, what I claim and desire to obtain by Letters Patent of the United States is:

1. A boomerang-action toy, comprising (a) a central hub, (b) an integral narrow outer annular rim spaced from and coplanar with said hub and coaxial therewith, said rim being of substantially uniform dimensions throughout, (c) a plurality of matching integral angularly spaced arms each defining an airfoil in cross-section and extending spirally between said hub and said rim and coplanar therewith, the outer terminus of said arms being proximate to the outer periphery of said rim and each of said arms originating from said hub, (d) the length of each of said arms generally corresponding in length to the radius of said toy, (e) the inner end of each arm extending generally radially from said hub and the outer end of each arm joining said rim at an acute angle to form with said rim an arm width at the outer end of said arm greater than the arm width at the inner end of said arm.

2. A boomerang-action toy according to claim 1 wherein said arms are six in number.

3. A boomerang-action toy according to claim 1 wherein the outer end of each of said arms connects to said rim at an angle of approximately 45° in a counterclockwise direction in advance of the inner end of said arm at said hub.

4. A boomerang-action toy according to claim 1 wherein the outer end of each of said arms connects to said rim at an angle of approximately 45° in a clockwise direction in arrears of the inner end of said arm at said hub.

5. A boomerang-action toy according to claim 1 wherein the angle of attack of each of said arms is approximately 10° with respect to the plane of said hub and said rim.

6. A boomerang-action toy according to claim 1 wherein in cross-section each of said arms is convex on its upper surface and concave on its lower surface and a rib is formed along the lower face of each of said arms, said rib disposed medially between the leading and trailing edges and extending substantially the full length thereof.

7. A boomerang-action toy according to claim 1 wherein the leading edge of each of said arms is thicker than the trailing edge thereof.

8. A boomerang-action toy according to claim 1 wherein the leading edge of each of said arms is narrower than the trailing edge thereof.

9. A boomerang-action toy according to claim 1 wherein said hub includes substantially flat upper and lower parallel faces and a plurality of flat side faces arrayed at equal angular spacings thereabout, each of said arms originating from a different one of said flat side faces.

* * * * *